US005488400A

United States Patent [19]

Crystal et al.

[11] Patent Number: 5,488,400

[45] Date of Patent: Jan. 30, 1996

[54] METHOD FOR REFILLING INK JET CARTRIDGES

[75] Inventors: Richard G. Crystal, Los Altos, Calif.; Raymond Geffre, Fort Fairfield, Me.; Sven Karlsson, San Jose, Calif.

[73] Assignee: Graphic Utilities, Inc., Concord, Mass.

[21] Appl. No.: 271,185

[22] Filed: Jul. 7, 1994

Related U.S. Application Data

[63] Continuation of Ser. No. 86,620, Jul. 1, 1993, abandoned, which is a continuation of Ser. No. 975,477, Nov. 12, 1992, abandoned.

[51] Int. Cl.[6] ..... B41J 2/175

[52] U.S. Cl. ..... 347/85

[58] Field of Search ..... 347/87, 85; 141/2, 141/18

[56] References Cited

U.S. PATENT DOCUMENTS

| | | | |
|---|---|---|---|
| 4,347,524 | 8/1982 | Engel et al. | 346/140 R |
| 4,500,895 | 2/1985 | Buck et al. | 346/140 R |
| 4,509,062 | 4/1985 | Low et al. | 346/140 R |
| 4,683,481 | 7/1987 | Johnson | 346/140 R |
| 4,771,295 | 9/1988 | Baker et al. | 346/1.1 |
| 4,794,410 | 12/1988 | Taub et al. | 346/140 R |
| 4,812,859 | 3/1989 | Chan et al. | 346/140 R |
| 4,827,294 | 5/1989 | Hanson | 346/140 R |
| 4,862,197 | 8/1989 | Stoffel | 346/140 R |
| 4,872,027 | 10/1989 | Buskirk et al. | 346/140 R |
| 4,967,207 | 10/1990 | Ryder | 347/87 |
| 4,992,802 | 2/1991 | Dion et al. | 346/1.1 |
| 5,040,001 | 8/1991 | Dunn et al. | 346/140 R |
| 5,199,470 | 4/1993 | Goldman | 141/1 |
| 5,329,294 | 7/1994 | Ontawar et al. | 347/87 |

FOREIGN PATENT DOCUMENTS

0437363A2 7/1991 European Pat. Off. .

*Primary Examiner*—N. Le
*Attorney, Agent, or Firm*—Lappin & Kusmer

[57] ABSTRACT

A method of refilling an ink jet cartridge with ink. The cartridge has a housing which encloses an internal ink reservoir extending between top and bottom ends thereof, an ink fill aperture extending through the housing near its top end, and a means for sealing the ink fill aperture. The cartridge further includes a bladder in the reservoir, an air port affixed to the top of the housing, and a spring means which biases the bladder toward a minimum volume state. According to the method, the cartridge is positioned with its top end above its bottom end, the ink fill aperture is unsealed, and the air port is sealed. The bladder is inflated to establish an internal volume in a predetermined range. Ink is then injected into the reservoir through the ink fill aperture. The ink fill aperture is then sealed, and the air port unsealed.

17 Claims, 4 Drawing Sheets

METHOD FOR REFILLING INK JET CARTRIDGES

This application is a Continuation of U.S. patent application Ser. No. 08/086,620 filed Jul. 1, 1993 now abandoned, which is a Continuation application of U.S. patent application Ser. No. 07/975,477 filed Nov. 12, 1992 now abandoned, both entitled "Method For Refilling Ink Jet Cartridges".

BACKGROUND OF THE INVENTION

The present invention generally relates to the field of ink jet printers and, in particular, to a method for refilling ink cartridges used with such printers.

A significant expense associated with the operation of ink jet printers is the cost of replacing the printer's ink cartridge once the cartridge's charge of ink has been exhausted. Over the lifetime of a printer, this cost can be substantial. The structural components of the ink cartridge, however, are quite durable and capable of far outlasting the cartridge's ink charge. As a result, discarding an ink cartridge simply because its ink charge has been expended is a wasteful, expensive practice.

Recently, the practice of recharging ink cartridges has become popular. In accordance therewith, rather than discarding a cartridge simply because its ink charge has been expended, the cartridge is recharged with a fresh supply of printing ink. However, this practice depends upon the type of ink cartridge needing recharging.

One method used to refill ink jet cartridges is to inject ink through an ink reservoir cavity breather port. Or, because the method is often messy and inefficient, another more effective way to refill these types of ink cartridge is through the device or method types described in the U.S. Pat. No. 5,199,470. The teachings in that pending patent application are incorporated herein by reference and show how to clear a hole in the expended cartridge reservoir and inject ink through a nozzle when an elastic, ink-filled cavity is squeezed by the user.

Nevertheless, these methods and apparatus are unsuitable for the newer and more efficient ink jet cartridges. Such cartridges typically include accumulators to accommodate variations in volume as the cartridge ejects ink or is exposed to other environments. The accumulators in these ink jet cartridges may include a bladder linked to ambient air pressure and connected to a volume-minimizing spring. Typically, the bladder resides at one pressure and expands or contracts to maintain operational back-pressure in the remaining portion of the cavity which contains the ink. Hewlett-Packard Company describes such a device in European Patent Application No. EP 04 37363 A2. The prior art refill methodology and devices do not consider this type of ink jet cartridge and will not work effectively.

It is therefore an object of the present invention to provide methodology for recharging ink cartridges. It is another object of the invention to provide a methodology for recharging ink cartridges with less ink spillage, and hence more economy, than known methods. It is another object of the invention to provide a method for refilling cartridges which contain bladder cavities or other similar ink jet cartridges. It is still another object of the invention to provide an improved method for recharging ink jet cartridges.

SUMMARY OF THE INVENTION

These and other objects of the invention are achieved by the present invention which, in one aspect, provides a method for refilling a partially or completely depleted ink jet cartridge with ink. The ink jet cartridge has a housing which includes an internal ink reservoir and can include an ink jet prim head which is coupled to the bottom of the cartridge. A bubble generator is affixed to the lower portion of the housing and can include a capillary passage connecting the ink supply to the region exterior to the cartridge. There is an ink fill aperture at the top end of the housing which provides a sealable passageway connecting the ink supply to the exterior region of the cartridge. Furthermore there is a negative pressure assembly within the ink jet cartridge which includes a bladder disposed in the ink reservoir with an air port coupling the region exterior to this ink cartridge to the inner volume of the bladder. There is a spring connected to the bladder and ink cartridge housing to bias the bladder towards a minimum volume state.

The refilling method comprises the steps of positioning the cartridge so that the top end is upward and such that the air port to the bladder is sealed. The ink fill aperture is then unsealed and ink is injected into the reservoir. Finally, the ink fill aperture is sealed and the air port to the bladder assembly is opened.

In other aspects, the bubble generator is sealed prior to filling the ink reservoir with ink. It is unsealed once the ink fill aperture to the ink reservoir cavity is sealed. A method is also provided wherein the step of unsealing the ink fill aperture is accomplished by clearing an air flow path in the ink reservoir cavity. This air flow path operates as an ink fill aperture and is plugged or sealed according to the teachings herein.

Alternatively, the method includes the steps of positioning the ink jet cartridge such that the top end, which includes the ink fill aperture, is upward. The ink fill aperture is unsealed and the air port to the bladder region is then sealed and inflated to establish an internal volume for the bladder which is within a predetermined range. Ink is injected into the reservoir through the ink fill aperture where it is afterwards sealed. Finally, the ink cartridge equilibrates allowing the bubble generator to draw in air before the air port to the bladder is unsealed.

According to other aspects, the inflation of the bladder is accomplished through the use of a syringe or by creating a vacuum in the ink reservoir cavity through the fill aperture or the capillary passage.

In still other aspects, the cartridge also includes a bubble generator with a gravity actuated check valve and capillary passage. Once the fill aperture is opened or an air flow path created to the ink reservoir cavity, ink is injected into the ink cavity and sealed. The cartridge is then overturned such that the bottom end is upwards. The bladder is then inflated to a predetermined volume by drawing a vacuum through the capillary passage and gravity actuated check valve.

These and other features of the invention will be more fully appreciated by reference to the following detailed description which is to be read in conjunction with the attached drawings.

DETAILED DESCRIPTION OF THE ILLUSTRATED EMBODIMENT

The present invention provides, generally, methodology for refilling ink cartridges containing pressure sensitive accumulators or bladders, including, for example, the devices described in European Patent Application 0437 363 A2 by the Hewlett-Packard Company. Therefore, it is extremely useful to describe the operation of these prior art devices before advancing to the more detailed description of the present invention.

Figure 1:
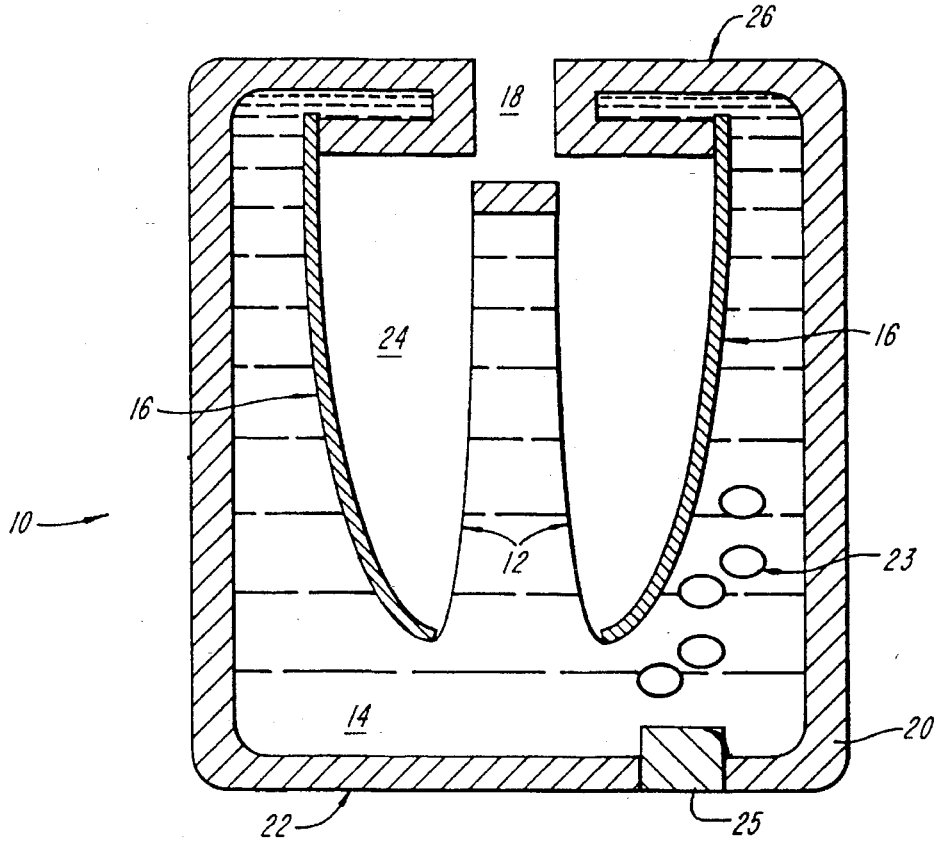
FIG. 1 (PRIOR ART)
FIG. 1 is a prior art design of an ink jet cartridge.

FIG. 1 shows a schematic view of a prior art pressure sensitive ink cartridge 10. The cartridge 10 contains a bladder 12 within the ink reservoir cavity 14. The bladder 12 is mounted to a spring 16 that operates to bias the bladder 12 volume toward its minimum value. The volume contained within the bladder 12 is connected to the atmosphere outside the cartridge 10 via a passageway air port 18. The bladder 12 is therefore typically maintained at ambient air pressure. Its volume varies depending upon the pressure within the ink reservoir cavity 14 and outside the cartridge 10.

The cartridge 10 illustrated in FIG. 1 is designed so that operational backpressure is maintained in the cavity 14 when it is exposed to other environmental conditions and when ink is depleted during operation. A print head is typically included as part of the cartridge 10 and connected at the bottom portion 22 of the cartridge wall 20. Ink heads in these and other cartridges require a partial vacuum in cavity 14 so that they do not leak. However, the vacuum cannot be greater than the drawing power of the ink pen itself. Thus, the backpressure component of the cavity 14 is very important. The critical feature of the bladder 12 and spring 16 is that they work in combination to maintain a near uniform and operational backpressure within cavity 14 even though ink is discharged from the cartridge 10, or similarly, if the cartridge 10 changes environments. More precisely, the bladder 12 increases its inner volume 24 with the atmosphere and pressure outside the cartridge 10 as ink is discharged from cavity 14. At the same time, the spring 16 works to bias the bladder volume 24 towards its minimum size for a given set of pressure conditions in the cavity 14 and outside the ink jet cartridge 10. Once the bladder reaches its maximum volume, a bubble generator 25 operates to fill further depleted ink volume with air. The bubble generator 25, for example, can include a capillary passage in the housing 20 for passing air bubbles 23 into the ink reservoir cavity 14.

As to the features of the present invention, they relate to the fill procedures necessary to add ink to the cartridge 10. In particular, the passageway 18 is initially sealed and an air flow path from the ink cavity 14 to the region exterior of the cartridge 10 is created at the upper end 26 of the housing 20. The air flow path at the upper housing area 26 is created by opening a fill aperture (not shown in FIG. 1) located in the upper region 26; or if unavailable, a hole is created according to further embodiments of the invention.

Figure 2A:
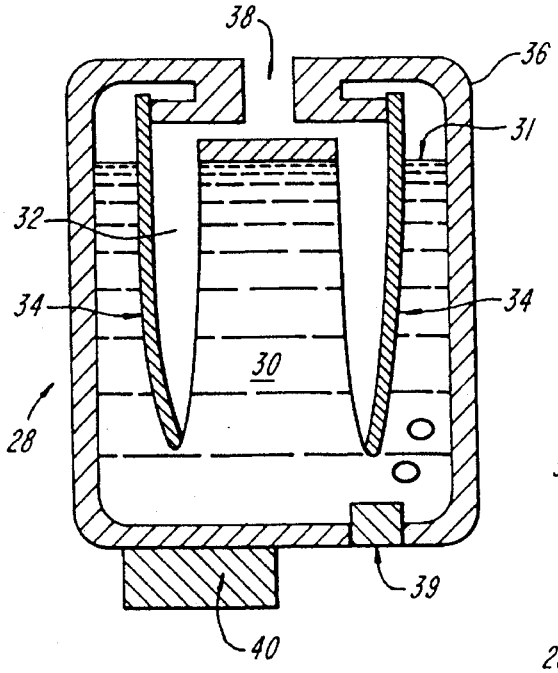
FIG. 2A (PRIOR ART)
FIG. 2A is a prior art design of an ink jet cartridge with a full ink supply.
Figure 2B:
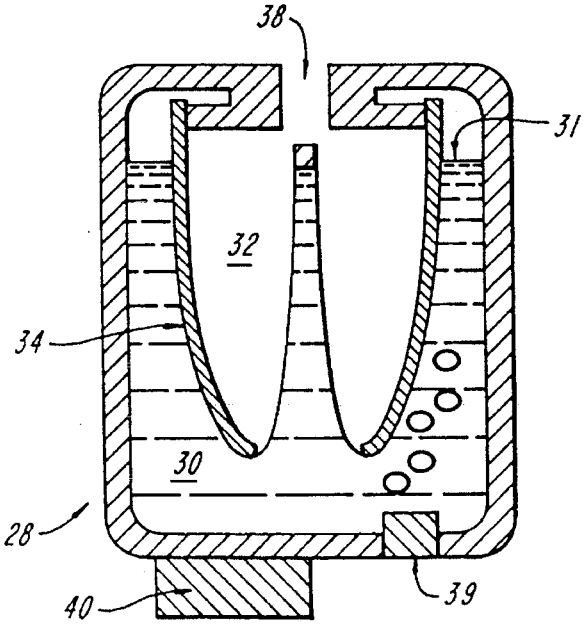
FIG. 2B (PRIOR ART)
FIG. 2B is a prior art design of an ink jet cartridge with a partially depleted ink supply.

FIGS. 2A–2B illustrate the general operation of the ink jet cartridge described in FIG. 1. FIG. 2A shows an exemplary ink cartridge 28 in its new and unused state. The ink reservoir cavity 30 is substantially full at ink level 31 and the bladder 32 is correspondingly small. A spring 34 affixed to the bladder 32 and the housing 36 works to bias the bladder 32 at its relatively small size. The bladder 32 is connected to the atmosphere and pressure outside the ink jet cartridge 28 via the passageway air port 38. Both the spring 34 and the bladder 32 work together to maintain an operational backpressure (negative vacuum) in the ink reservoir cavity 30. Operational backpressure is needed to ensure that ink does not leak through the print head 40. The print head 40 may be detached or may be an integral part of the housing 36.

The backpressure within cavity 30 can significantly change with the environment, such as air transportation conditions. But the bladder 32 will increase or decrease in size depending upon the pressure and atmosphere conditions outside the ink jet cartridge 28. The spring 34 in addition tends to bias the expanding or contracting bladder 32 at a minimum volume.

Backpressure also changes operationally when ink is expelled from the cavity 30 through the ink print head 40. FIG. 2B illustrates how the volume of bladder 32 changes according to the amount of ink remaining in the cavity 30. The bladder 32 has expanded in volume in order to compensate for the loss of ink from the cavity 30, maintaining a high ink level line 31. The atmosphere within the bladder 32 is similar to the pressure outside the ink jet cartridge 28 since the bladder 32 is in fluid communication with the outside via the passageway air port 38. Even under partially or depleted ink conditions, the bladder 32 and spring 34 work together to maintain operational backpressure within the cavity 30. Once the bladder 32 reaches its maximum volume, a bubble generator 39 operates to fill the ink cavity 30 with air to further maintain operational backpressure when ink is discharged beyond the capability of the bladder 32. The bubble generator 39 can operate with an air opening, a check valve, a liquid seal and semipermeable membrane, or other ways constructed and known in the art.

A reduction of the ink supply increases backpressure; or more descriptively, ink reduction increases the partial vacuum within the cavity 30. The ink jet print head 40 must overcome this vacuum in order to make ink available for printing. The device as described in FIGS. 2A, 2B compensates for this effect by increasing the volume of the bladder 30, by operation of the volume minimizing spring 34, and by the bubble generator 39.

Figure 3A:
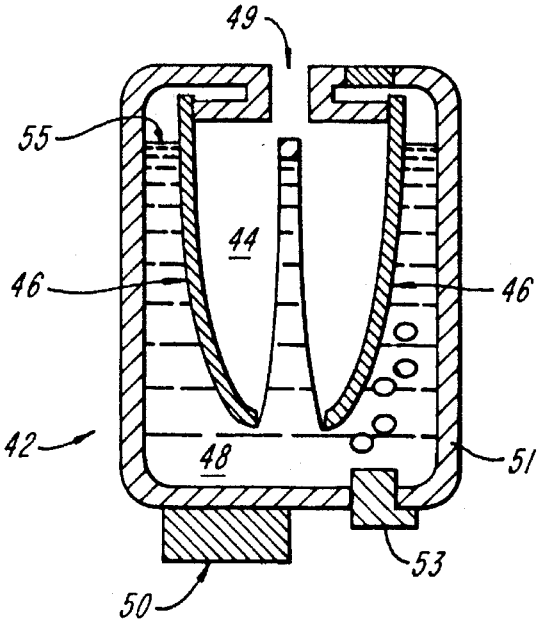
FIGS. 3A–3D show schematically the preferred refill procedures and sequential ink cartridge states for applying methodology according to the invention.

FIGS. 3A–3D illustrate the refill procedure methodology and related ink jet states according to the present invention. FIG. 3A illustrates the prior art embodiment of a partially depleted ink jet cartridge 42. The bladder 44 and springs 46 reside at a state to maintain the desired operational back pressure within the ink reservoir cavity 48. The atmosphere and pressure within the bladder 44 is similar to that outside the ink jet cartridge 42 because of the passageway air port 49. An ink jet head 50 is either attached or detached to the ink jet housing 51. A bubble generator 53 fills the ink reservoir cavity 48 with air, for example through a capillary passageway, once the vacuum inside the cartridge reaches a threshold. The bubble generator 53 prevents a vacuum from reaching a sufficient level against which the print head 50 can no longer eject ink.

Figure 3B:
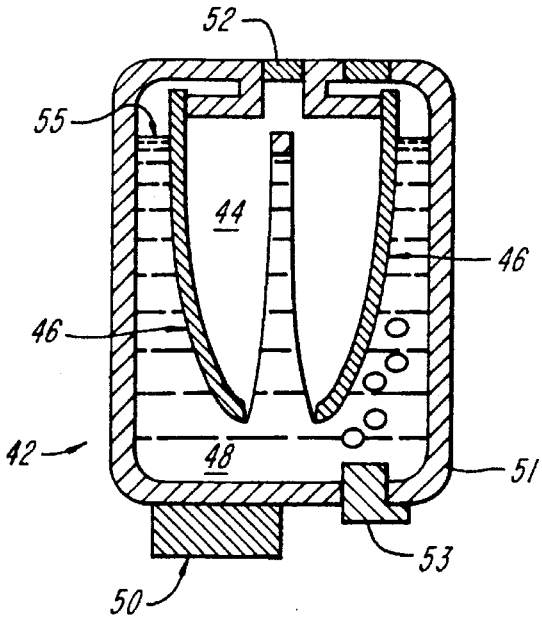

FIG. 3B illustrates the first step in refilling the ink jet cartridge 42. First, the ink jet cartridge 42 must be placed so that its top end, i.e., the end with the air port 49, is above its bottom end, i.e., the end with the print head 50. Once the position of the ink jet cartridge 42 is correct, the air port 49 is sealed with an appropriate seal 52 such that the passageway connection from the outside atmosphere to the inside of the bladder 44 is closed. The ink jet cartridge 42 in this state stops the fluid communication of the bladder 44 with the outside atmosphere.

Figure 3C:
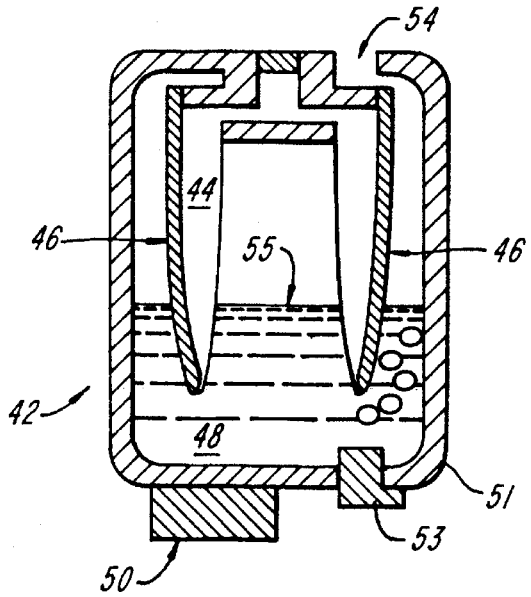

FIG. 3C illustrates the next step according to the present invention. The step opens a fill aperture 54 for access to the ink supply within the cavity 48. This fill aperture can be created by unsealing an existing fill aperture-if available- or by creating an air flow path with a tool such as described in U.S. Pat. No. 5,199,470. The ink fill line 55 is correspondingly low. Ink is injected through the fill aperture 54 to recharge the ink reservoir cavity 48. The bladder 44 is compressed to a higher pressure and smaller volume to accommodate the increased ink volume within the cavity 48.

Figure 3D:
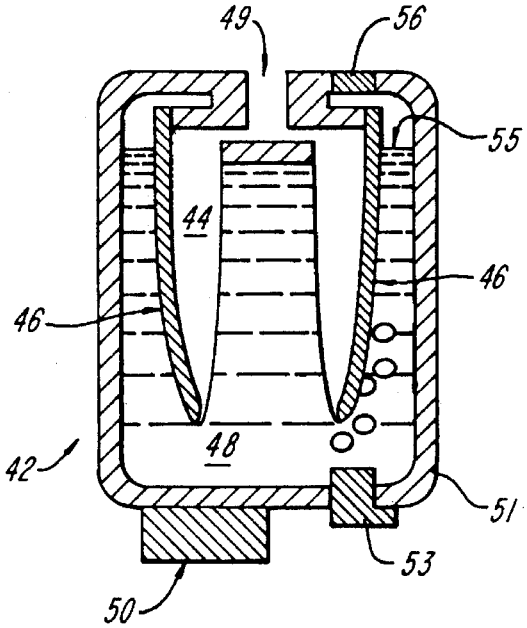

Once the ink reservoir cavity 48 is recharged, the ink fill aperture 54 is sealed with a plug or seal 56, and the bladder air port 49 is reopened by removing the seal 52 (FIGS. 3B, 3C). FIG. 3D illustrates the final state of the ink jet cartridge in the refill process according to the invention. The bladder 44 is again in fluid communication with the atmosphere outside the ink jet cartridge 42. Once the air port 49 is reopened, the ink cavity 48 pressure and spring arrangement 46 work to resize the bladder 44 so that operational back-pressure is established and maintained during the discharge of ink, or during environment changes outside the ink cartridge 42. The ink cartridge 42 of FIG. 3D is in the same state as in FIG. 3A, except that its ink reservoir supply is full, whereas in FIG. 3A it is nearly depleted.

In the FIG. 3B illustration, it is sometimes preferable to seal the bubble generator 53 prior to sealing the air port 49 with the seal 52. This tends to prevent potential leak points in the cartridge 42, for example through a capillary passageway at the bubble generator 53. The bubble generator 53 is unsealed when all other steps are completed, for instance, when the ink jet cartridge is in the state shown in FIG. 3D.

Figure 4A:
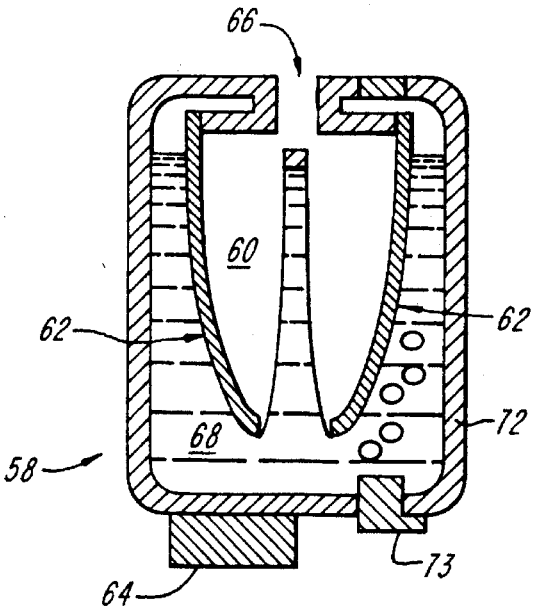
FIGS. 4A–4D show schematically another refill procedure and sequential ink cartridge states for applying methodology according to the invention.

In another embodiment of the invention, FIGS. 4A–4D illustrate a method for refilling ink jet cartridges. Like FIG. 3A, FIG. 4A shows a partially depleted ink jet cartridge 58 which needs recharging. The bladder 60 and springs 62 maintain operational back pressure to ensure ink does not leak but can be operationally expelled from the ink head 64. The air port 66 puts the bladder 60 in fluid communication with the atmosphere outside the ink jet cartridge 68.

Figure 4B:
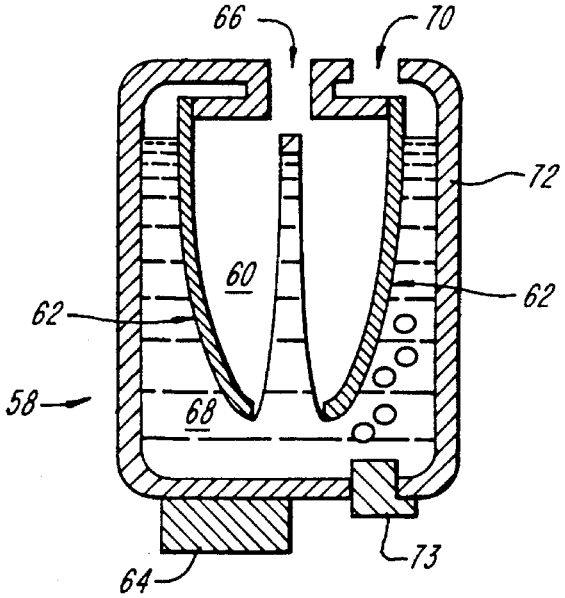

FIG. 4B illustrates the first step according to this embodiment whereby an ink fill aperture 70 is created in the ink reservoir 68. This aperture 70 can be created by opening a pre-existing seal or by clearing an air flow path in the cavity wall 72 near the top of the cartridge 58. In this state, both the bladder 60 and the cavity 68 are in fluid communication with the atmosphere outside the cartridge 58.

Figure 4C:
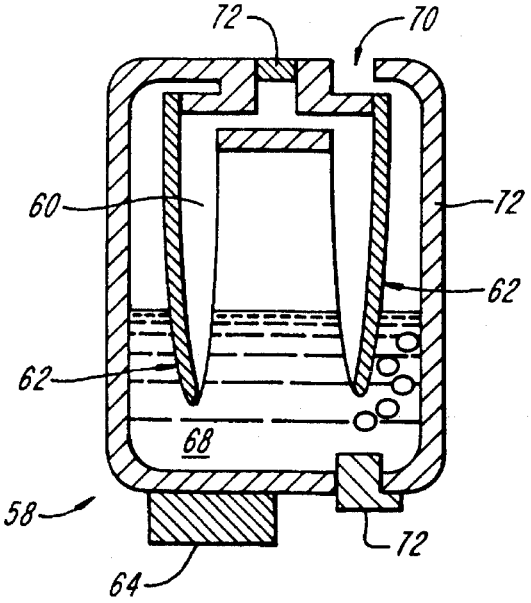

In FIG. 4C the air port 66 is sealed with a seal or plug 72 and the bladder 60 is inflated to a predetermined size by passing air into the bladder 60 via a device such as a syringe, bulb, or bellows. Ink is then injected into the cavity 68 through the ink fill aperture 70.

Figure 4D:
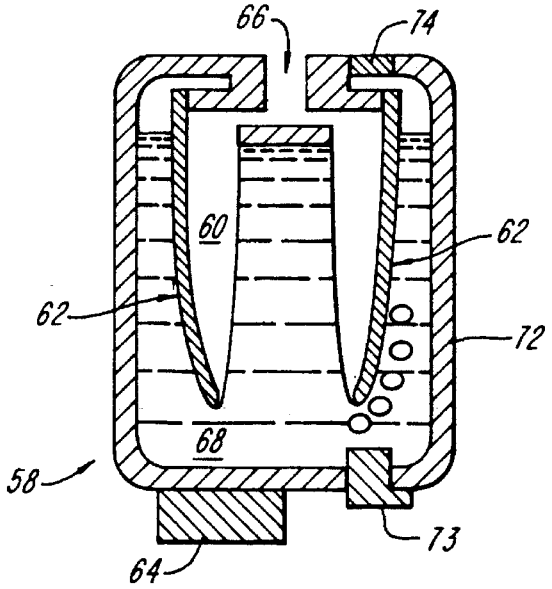

The next steps are illustratively shown in FIG. 4D. The ink fill aperture 70 is sealed with a seal or plug 74 and then air port seal 72 is removed to create air port 66. The ink jet cartridge 58 returns to a state for operational use.

As an alternative to the methods described in FIGS. 4A–4D, the invention provides for drawing a vacuum via a fill aperture 70. The step described in FIG. 4C wherein the bladder 60 is inflated, can be accomplished by attaching a collapsible accordion bottle, bellows, syringe or similar suction device to the fill aperture 70 or to the bubble generator 73. For example, bellows which are first collapsed and then attached to fill aperture 70 will expand and draw a vacuum into the cartridge 58. The vacuum alters the pressure in the cavity 68 and the bladder 60 expands accordingly. Once the bladder expands to a predetermined size, ink is then inserted into aperture 70 and sealed once the cavity 68 is full. Finally, the air port 66 is opened so that the bladder 60 is again in fluid communication with the atmosphere outside the cartridge 58 and an operational back pressure is created in the cavity 68.

At times it may be advisable to seal and unseal the bubble generator 73 to close possible leak points in the cartridge 58. The bubble generator 73 is most effectively sealed prior to opening the ink fill aperture 70 of FIG. 4B, and closed at the end of all other steps, as shown in FIG. 4D.

Figure 5:
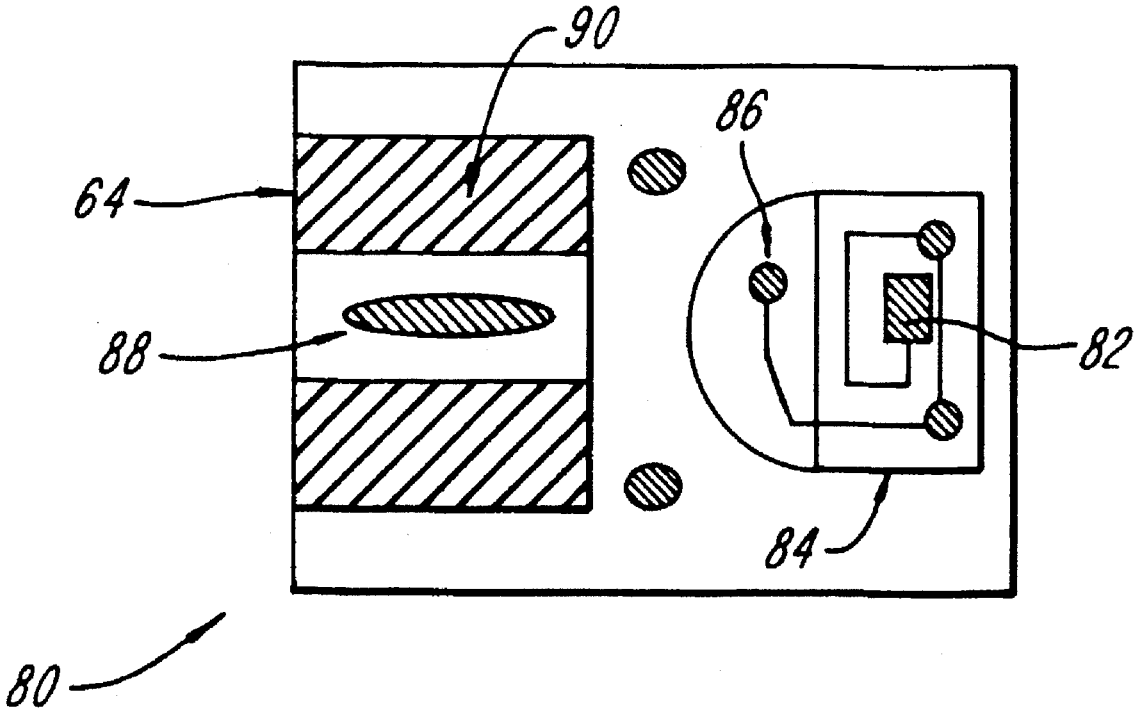
FIG. 5 illustrates a lower ink cartridge assembly for applying the methods of the invention.

In some configurations, the bubble generator 73 (of FIGS. 4A–4D) will operate via a gravity activated check valve, a capillary passageway, an air opening, a semi-permeable membrane, or other means known to the art. FIG. 5 illustrates a lower ink cartridge assembly 80 and bubble generator with an air opening 82. With such an assembly 80, the inflating step described in FIG. 4C can be accomplished by turning the cartridge 58 upside down and drawing a vacuum through the air opening 82 of the bubble generator 73. FIG. 5 also shows print head 64, the bubble generator vent line 84, the internal bubble generator valve 86, nozzle plate 88, and electrical leads 90.

More specifically, first the aperture 70 of FIGS. 4A–4D is opened and ink is injected into the reservoir cavity 68. The fill aperture 70 is then closed and the cartridge 58 is placed upside down so the aperture 70 is below the bubble generator 73. The bladder 60 is expanded when the vacuum is drawn through the bubble generator 73 and air opening 82 (shown schematically in FIG. 5). Once this is completed, the bladder 60 and spring 62 work to establish and maintain an operational back-pressure within the cavity 68.

By use of the present invention, therefore, it is possible to extend the life of a cartridge by recharging it with ink when its original supply of ink has been exhausted. If no fill aperture is provided, and an air flow path is cleared into the ink cavity, refills subsequent to the first refill will not require an additional air flow path, since the same fill path can be used again.

Other alterations to the above-described embodiments will be readily apparent to those ordinarily skilled in the art and are intended to be embraced within the spirit and scope of the invention. That is, the above description is intended as illustrative rather than limiting. The invention is to be defined, therefore, not by the preceding description but by the claims that follow.

What is claimed is:

1. The method of re-filling with ink an at least partially depleted ink jet cartridge, said cartridge having a top end and a bottom end including:

(a) a housing enclosing an internal ink reservoir extending between said top end and said bottom end, (b) a bubble generator affixed to the housing, (c) an ink fill aperture extending through said housing near said top end and coupling said reservoir to a region exterior to said cartridge, (d) a means for sealing said ink fill aperture, (e) a negative pressure assembly including:

i. a bladder disposed within said reservoir, ii. an air port affixed to the top of said housing including means for coupling a region interior to said bladder to said region exterior to said cartridge, iii. spring means for biasing said bladder toward a minimum volume state, comprising the steps of:

A. positioning said cartridge with said top end above said bottom end,

B. unsealing said ink fill aperture,

C. sealing said air port and then inflating said bladder to establish an internal volume thereof in a predetermined range, D. injecting ink into said reservoir through said ink fill aperture, E. sealing said ink fill aperture, and F. unsealing said air port.

2. The method of claim 1 wherein an ink jet print head is coupled to said reservoir.

3. The method of claim 1 comprising the further steps of:

G. prior to said step B, sealing said bubble generator, and

H. after said step F, unsealing said bubble generator.

4. The method of claim 1 wherein said inflating step is established using a syringe.

5. The method of claim 1 wherein said inflating step is established by drawing a vacuum through at least one of said fill aperture and said bubble generator.

6. The method of re-filling with ink an at least partially depleted ink jet cartridge, said cartridge having a top end and a bottom end including:

(a) a housing enclosing an internal ink reservoir extending between said top end and said bottom end, (b) a bubble generator affixed to the housing, (c) a negative pressure assembly including:

i. a bladder disposed within said reservoir, ii. an air port affixed to the top of said housing including means for coupling a region interior to said bladder to a region exterior to said cartridge, iii. spring means for biasing said bladder toward a minimum volume state, comprising the steps of:

A. positioning said cartridge with said top end above said bottom end,

B. establishing an air flow path between said internal ink reservoir and said region exterior to said cartridge, C. sealing said air port and then inflating said bladder to establish an internal volume thereof in a predetermined range, D. injecting ink into said reservoir through said air flow path, E. sealing said air flow path, and F. unsealing said air port.

7. The method of claim 6 comprising the further steps of:

G. prior to said step B, sealing said bubble generator, and

H. after said step F, unsealing said bubble generator.

8. The method of claim 6 wherein said inflating step is established using a syringe.

9. The method of claim 6 wherein said inflating step is established by drawing a vacuum through at least one of said air flow path and said bubble generator.

10. The method of re-filling with ink an at least partially depleted ink jet cartridge, said cartridge having a top end and a bottom end including:

(a) a housing enclosing an internal ink reservoir extending between said top end and said bottom end.

(b) a bubble generator including a gravity activated check valve and a capillary passage extending through said housing near said bottom end and coupling said reservoir to a region exterior to said housing, (c) an ink fill aperture extending through said housing near said top end and coupling said reservoir to a region exterior to said cartridge, (d) a means for sealing said ink fill aperture, (e) a negative pressure assembly including:

i. a bladder disposed within said reservoir, ii. an air port affixed to the top of said housing including means for coupling a region interior to said bladder to said region exterior to said cartridge, iii. spring means for biasing said bladder toward a minimum volume state, comprising the steps of:

A. positioning said cartridge with said top end above said bottom end,

B. unsealing said ink fill aperture,

C. injecting ink into said reservoir through said ink fill aperture,

D. sealing said ink fill aperture,

E. positioning said cartridge with said bottom end above said top end, and

F. inflating said bladder to establish an internal volume thereof in a predetermined range.

11. The method of claim 10 wherein an ink jet print head is coupled to said reservoir.

12. The method of claim 10 wherein said inflating step is accomplished by drawing air from said internal ink reservoir through said capillary passage and said gravity actuated check valve to a region exterior to said cartridge.

13. The method of claim 10 wherein said inflating step is accomplished using a syringe.

14. The method of re-filling with ink an at least partially depleted ink jet cartridge, said cartridge having a top end and a bottom end including:

(a) a housing enclosing an internal ink reservoir extending between said top end and said bottom end, (b) a bubble generator including a gravity actuated check valve and a capillary passage extending through said housing near said bottom end and coupling said reservoir to a region exterior to said housing, (c) a negative pressure assembly including:

i. a bladder disposed within said reservoir, ii. an air port affixed to the top of said housing including means for coupling a region interior to said bladder to said region exterior to said cartridge, iii. spring means for biasing said bladder toward a minimum volume state, comprising the steps of:

A. positioning said cartridge with said top end above said bottom end,

B. establishing an air flow path between the interior of said internal ink reservoir and a region exterior to said cartridge, C. injecting ink into said reservoir through said air flow path, D. sealing said air flow path, E. positioning said cartridge with said bottom end above said top end, and F. inflating said bladder to establish an internal volume thereof in a predetermined range.

15. The method of claim 14 wherein an ink jet print head is coupled to said reservoir.

16. The method of claim 14 wherein said inflating step is accomplished by drawing air from said internal ink reservoir through said capillary passage and said gravity actuated check valve to a region exterior to said cartridge.

17. The method of claim 14 wherein said inflating step is accomplished using a syringe.

* * * * *